US007165995B2

(12) United States Patent
Fukushima et al.

(10) Patent No.: US 7,165,995 B2
(45) Date of Patent: Jan. 23, 2007

(54) ELECTROMAGNETIC INTERFERENCE SHIELDED CONNECTOR AND METHOD FOR ASSEMBLING THE SAME

(75) Inventors: Hirotaka Fukushima, Haibara-gun (JP); Takashi Tsukamoto, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/059,345

(22) Filed: Feb. 17, 2005

(65) Prior Publication Data

US 2005/0191904 A1 Sep. 1, 2005

(30) Foreign Application Priority Data

Feb. 17, 2004 (JP) ..... P2004-039810

(51) Int. Cl.
*H01R 13/648* (2006.01)

(52) U.S. Cl. ..... 439/607; 174/35 C; 174/35 R; 439/610

(58) Field of Classification Search ..... 439/607, 439/483–484, 610; 174/35 C, 35 R
See application file for complete search history.

(56) References Cited

U.S. PATENT DOCUMENTS 4,954,097 A * 9/1990 Sekiguchi ..... 439/352
5,944,559 A * 8/1999 Wu ..... 439/607
6,017,245 A * 1/2000 Karir ..... 439/610
6,135,818 A * 10/2000 Lang et al. ..... 439/610
6,583,352 B2 * 6/2003 Fukushima et al. ..... 174/373
6,815,610 B2 * 11/2004 Kuboshima et al. ..... 174/35 C
6,821,151 B2 * 11/2004 Lai ..... 439/610
6,921,292 B2 * 7/2005 Miyazaki ..... 439/564

FOREIGN PATENT DOCUMENTS

JP 7-193966 A 7/1995

* cited by examiner

*Primary Examiner*—Michael C. Zarroli
(74) *Attorney, Agent, or Firm*—Sughrue Mion, PLLC

(57) ABSTRACT

An electromagnetic interference shielded connector includes a plurality of electric wires, which has connecting parts at ends of the electric wires respectively; a connector housing, which contains the electric wires and the connecting parts; and a metallic shielding shell. The metallic shielding shell includes a cylindrical electric-wire drawn-out portion, through which the electric wires are drawn out; and a terminal drawn-out portion, from which the connecting parts are protruded. The connector housing is formed by an entire molding so as to fill a resin inside of the metallic shielding shell in a state that the electric wires are inserted through the electric-wire drawn-out portion and the connecting parts are drawn out through the terminal drawn-out portion.

5 Claims, 7 Drawing Sheets

ELECTROMAGNETIC INTERFERENCE SHIELDED CONNECTOR AND METHOD FOR ASSEMBLING THE SAME

BACKGROUND OF THE INVENTION

The present invention relates to an electromagnetic interference shielded connector adapted to be attached to front ends of a plurality of electric wires and to be mounted directly on a wall part of a device and method for assembling the same.

There have been disclosed related electromagnetic interference shielded connectors adapted to be attached to a front end of an electric wire (refer to JP-A-7-193966 (FIG. 1), for example).

In an electromagnetic interference shielded connector 100 as shown in FIG. 10, an insulating coating (sheath) 102 is peeled off at a front end of an electric wire 101, and a metallic reticulated wire (shielding braid) 103 is folded back toward the side of the sheath 102, while a core 104 is extended out of the terminal.

Around the circumference of the folded shielding braid 103 is tightened a metallic pressure contactor 110 in such a manner that an outer cylindrical portion 110*a* is tightened around the circumference of the shielding braid 103 with an insertion piece 110*b* being inserted tightly between the shielding braid 103 and the core 104. The front end portion of the electric wire 101 is inserted into a cylindrical grommet 111, which is attached firmly to the outer circumferential surface of the electric wire 101 to be waterproofed.

In an inner circumferential groove 111*a* of the grommet 111 is fitted a flare portion 110*c* of the pressure contactor 110. On the outside of the grommet 111 is provided a metallic box-shaped shielding cover 112 for shielding a connector portion 113 against electromagnetic waves, in which the shielding braid 103 is peeled off for connection.

Meanwhile, in the above-mentioned electromagnetic interference shielded connector 100, the metallic shielding cover 112 is separated above and below to be provided separately on the outside of the resin housing of the connector portion 113.

This configuration incurs disadvantages in that the number of parts is increased and that the assembly man-hours is also increased.

SUMMARY OF THE INVENTION

The present invention has been made in consideration of the above-mentioned problems, and an object thereof is to provide an electromagnetic interference shielded connector capable ensuring a waterproof function and electromagnetic shielding function, while reducing the number of parts as well as reducing the size thereof.

1) In order to achieve the above object, according to the present invention, there is provided an electromagnetic interference shielded connector, comprising:

a plurality of electric wires, which has connecting parts at ends of the electric wires respectively;

a connector housing, which contains the electric wires and the connecting parts; and a metallic shielding shell, which includes:

a cylindrical electric-wire drawn-out portion, through which the electric wires are drawn out; and a terminal drawn-out portion, from which the connecting parts are protruded, wherein the connector housing is formed by an entire molding so as to fill a resin inside of the metallic shielding shell in a state that the electric wires are inserted through the electric-wire drawn-out portion and the connecting parts are drawn out through the terminal drawn-out portion.

In the electromagnetic interference shielded connector arranged in such a manner as above, the metallic shielding shell internally including the cylindrical electric-wire drawn-out portion adapted to draw out the plurality of electric wires therethrough and the terminal drawn-out portion adapted to protrude the connecting parts at the front ends of the plurality of electric wires is provided, and the interior of the shielding shell is molded entirely with resin under such conditions that the electric wires are inserted through the electric-wire drawn-out portion and that the connecting parts are protruded from the terminal drawn-out portion.

It is thus not necessary to fit shielding shells in a sandwiching manner from above and below as used at the related art, which allows the number of parts to be reduced and wasted space to be eliminated for size reduction. The entire molding also allows a waterproof function to be ensured.

In addition, the shielding shell can be made of a metal such as aluminum.

2) Preferably, the electromagnetic interference shielded connector comprises a shell ring which is attached to around an outer circumferential surface of the electric-wire drawn-out portion to tight a braid to the shielding shell.

In the electromagnetic interference shielded connector arranged in such a manner as above, the braid is provided on the outer circumferential surface of the shielding shell and is tightened using the shell ring, which allows the braid to be attached to the shielding shell reliably.

It is thus possible to prevent the electric wires from falling out of the shielding shell.

3) Preferably, the terminal drawn-out portion is opened toward female terminals of a mating device. The connecting parts are connectable with the female terminals. A packing is provided between the terminal drawn-out portion and the mating device to seal the connecting parts.

In the electromagnetic interference shielded connector arranged in such a manner as above, the connection between the connecting parts of the electromagnetic interference shielded connector and the female terminal on the side of the device is sealed by the packing, which allows a waterproof function to be ensured.

4) Preferably, the shielding shell has a mounting portion for mounting the shielding shell on a wall part of a mating device.

In the electromagnetic interference shielded connector arranged in such a manner as above, it is possible to reliably mount the shielding shell on the wall part of the device via the mounting portion.

This allows electromagnetic waves to be shielded and waterproof characteristics to be ensured.

According to the present invention, there is also provided a method for assembling an electromagnetic interference shielded connector, comprising the steps of:

providing a plurality of electric wires which has connecting parts at ends of the electric wires respectively;

providing a connector housing which contains the electric wires and the connecting parts; and providing a metallic shielding shell which includes a cylindrical electric-wire drawn-out portion and a terminal drawn-out portion; and forming the connector housing by molding so as to fill a resin inside of the metallic shielding shell in a state that the electric wires are inserted through the electric-wire drawn-out portion and the connecting parts are drawn out through the terminal drawn-out portion.

In accordance with the present invention, it is possible to ensure a waterproof function and electromagnetic shielding function, while reducing the number of parts as well as reducing the size.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
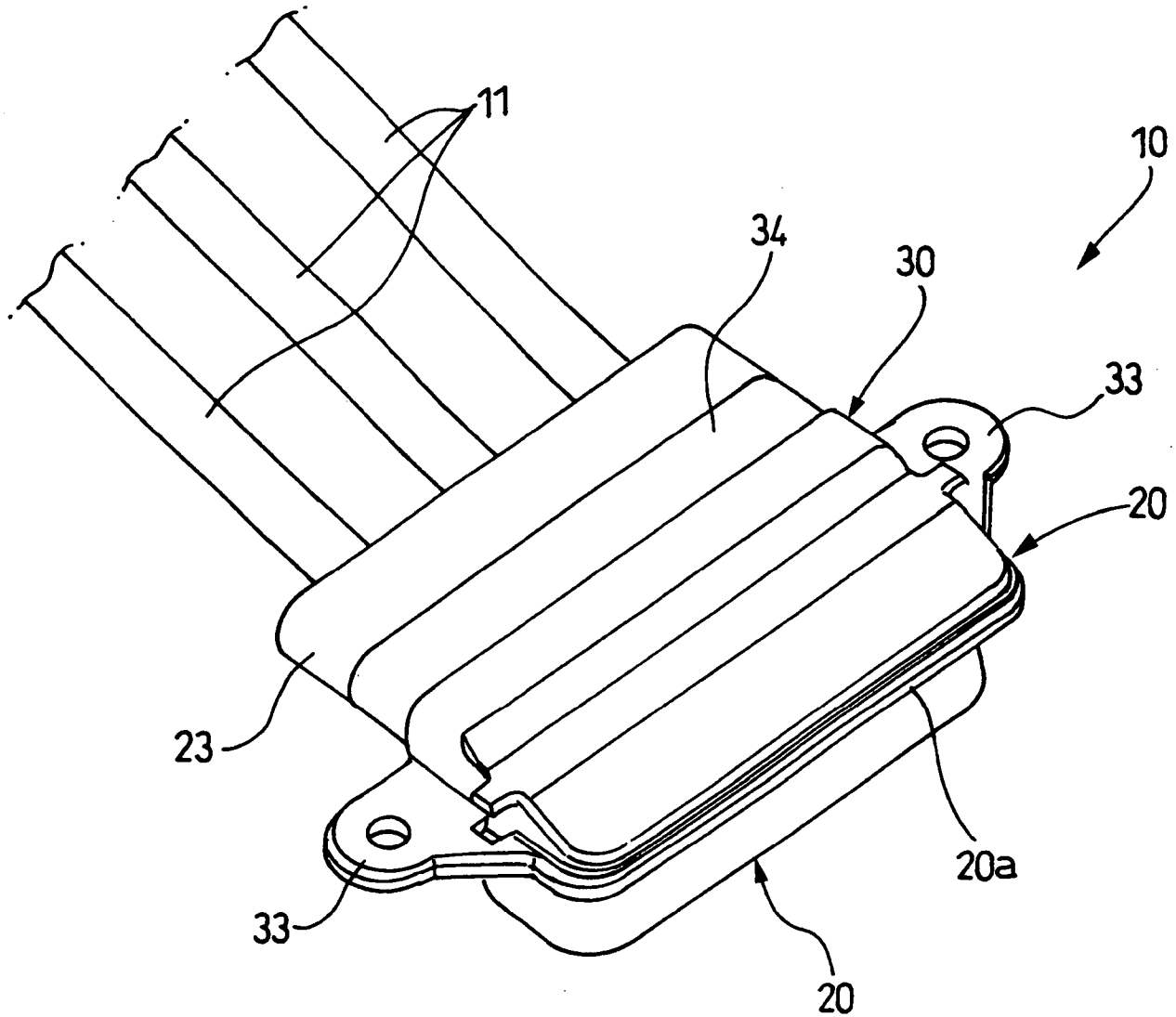
FIG. 1 is a perspective view of an electromagnetic interference shielded connector according to an embodiment of the present invention as seen from above.
Figure 2:
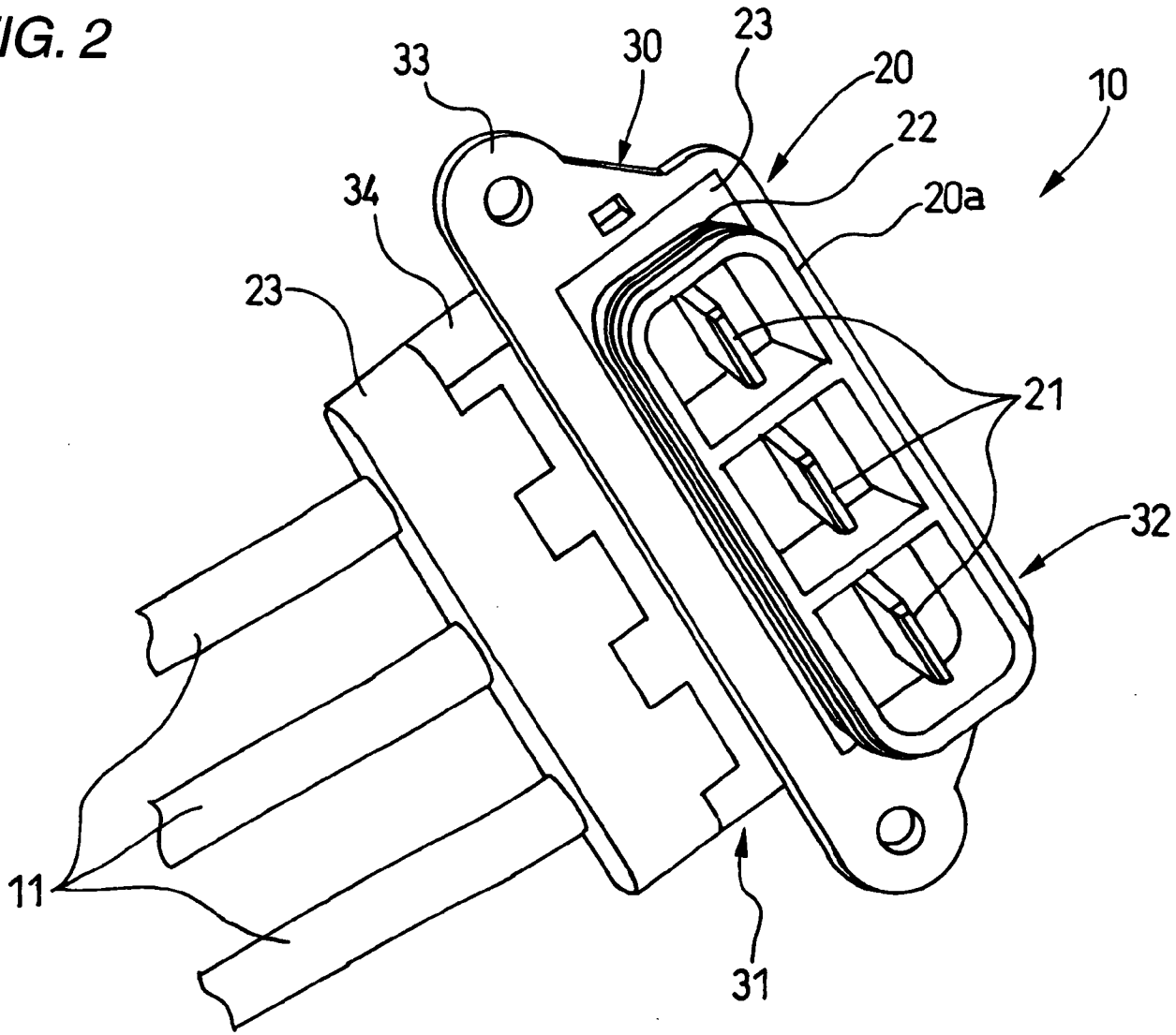
FIG. 2 is a perspective view of the electromagnetic interference shielded connector as seen from below.
Figure 3:
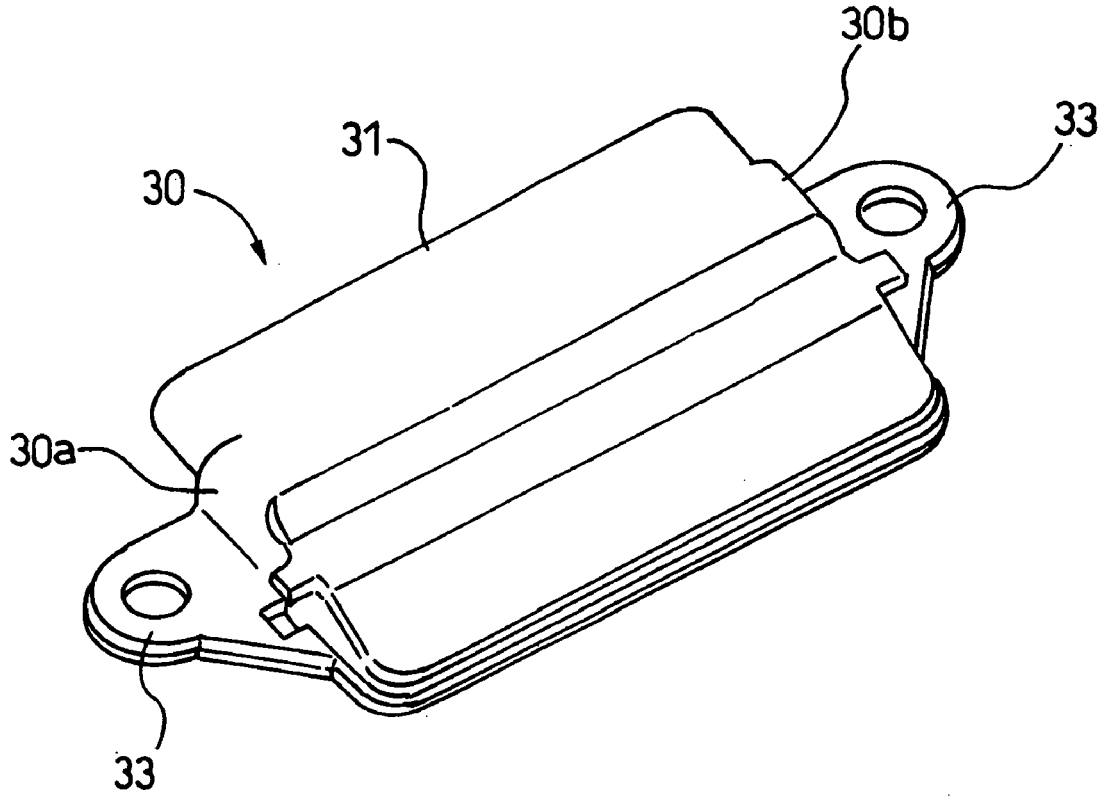
FIG. 3 is a perspective view of a shielding shell as seen from above.
Figure 4:
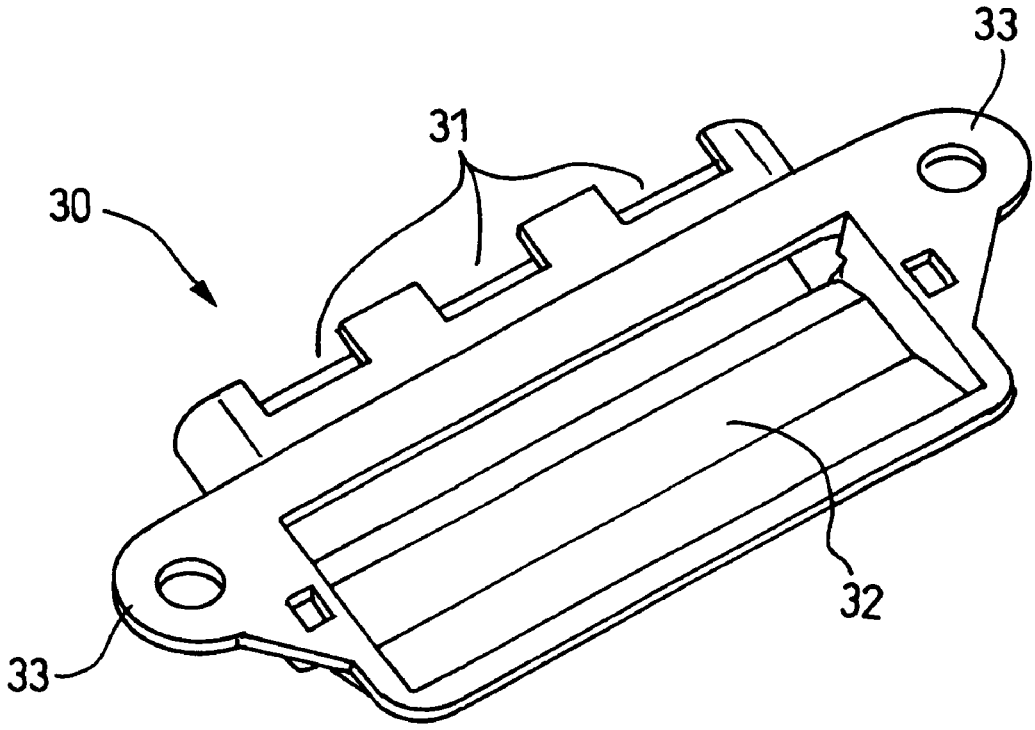
FIG. 4 is a perspective view of the shielding shell as seen from below.
Figure 5:
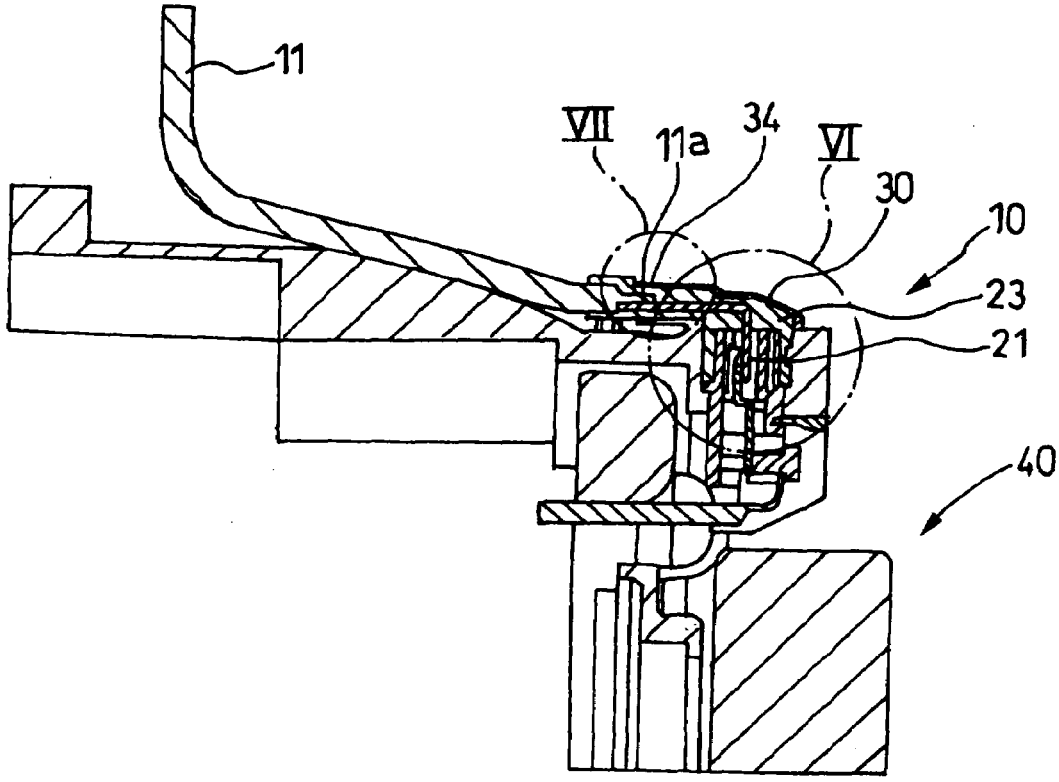
FIG. 5 is a cross-sectional view showing the front end and a mounting portion of the electromagnetic interference shielded connector.
Figure 6:
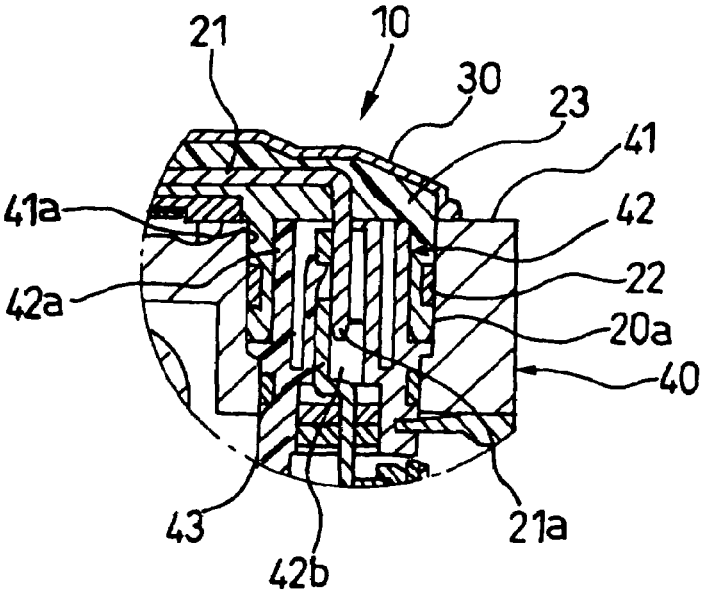
FIG. 6 is an enlarged cross-sectional view showing the part VI in FIG. 5.
Figure 7:
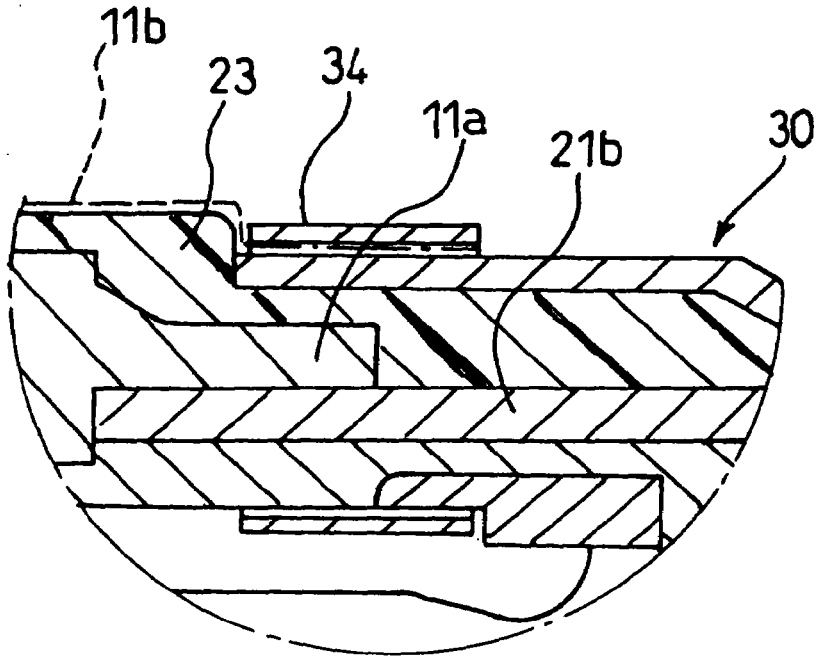
FIG. 7 is an enlarged cross-sectional view showing the part VII in FIG. 5.
Figure 8:
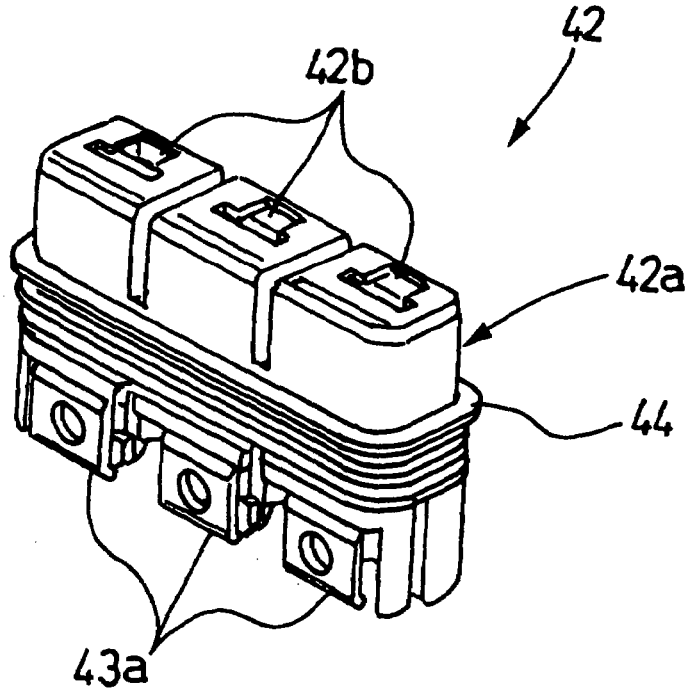
FIG. 8 is a perspective view of a female connector.
Figure 9:
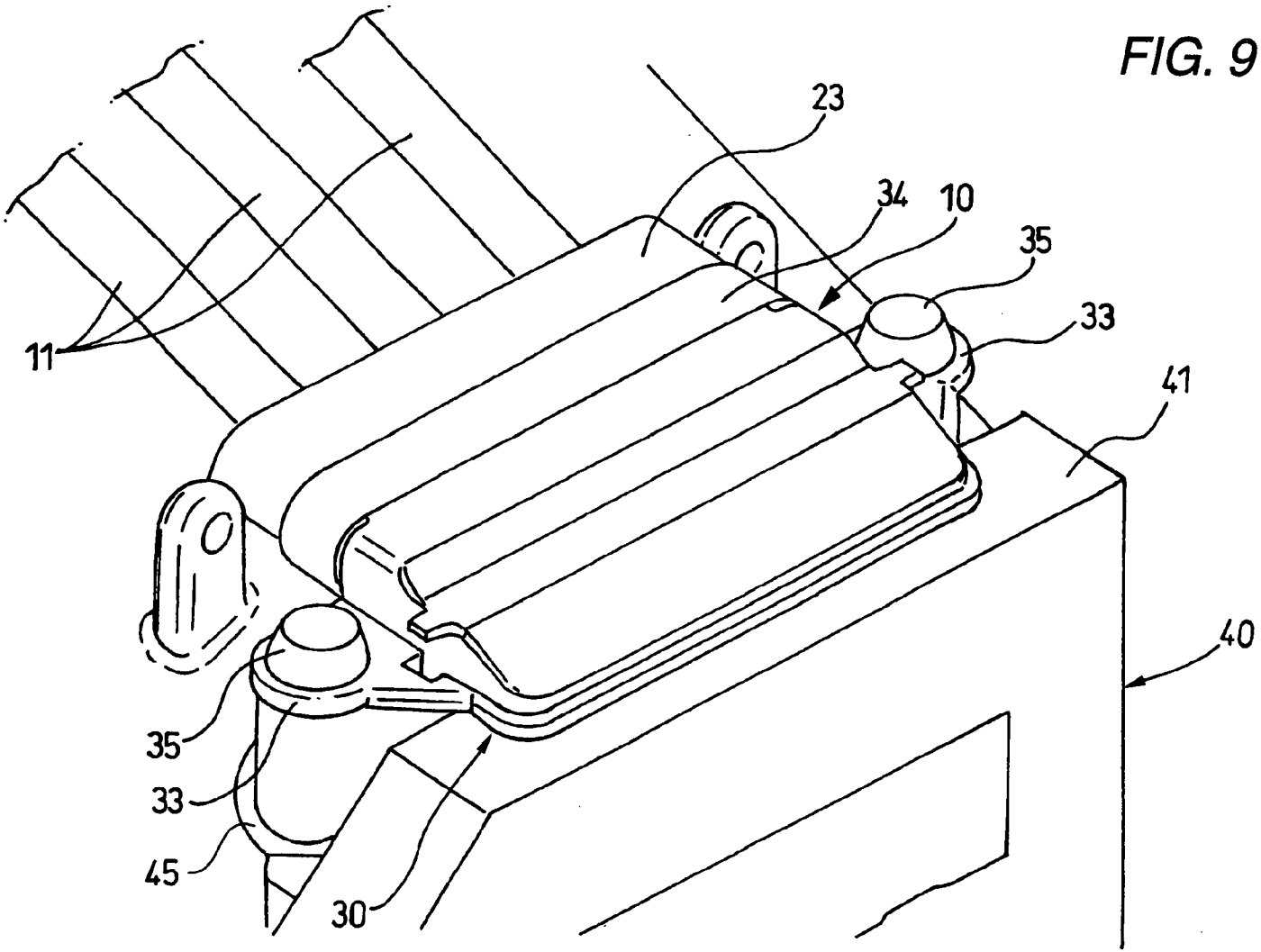
FIG. 9 is a perspective view showing a state where the electromagnetic interference shielded connector is mounted on a motor.
Figure 10:
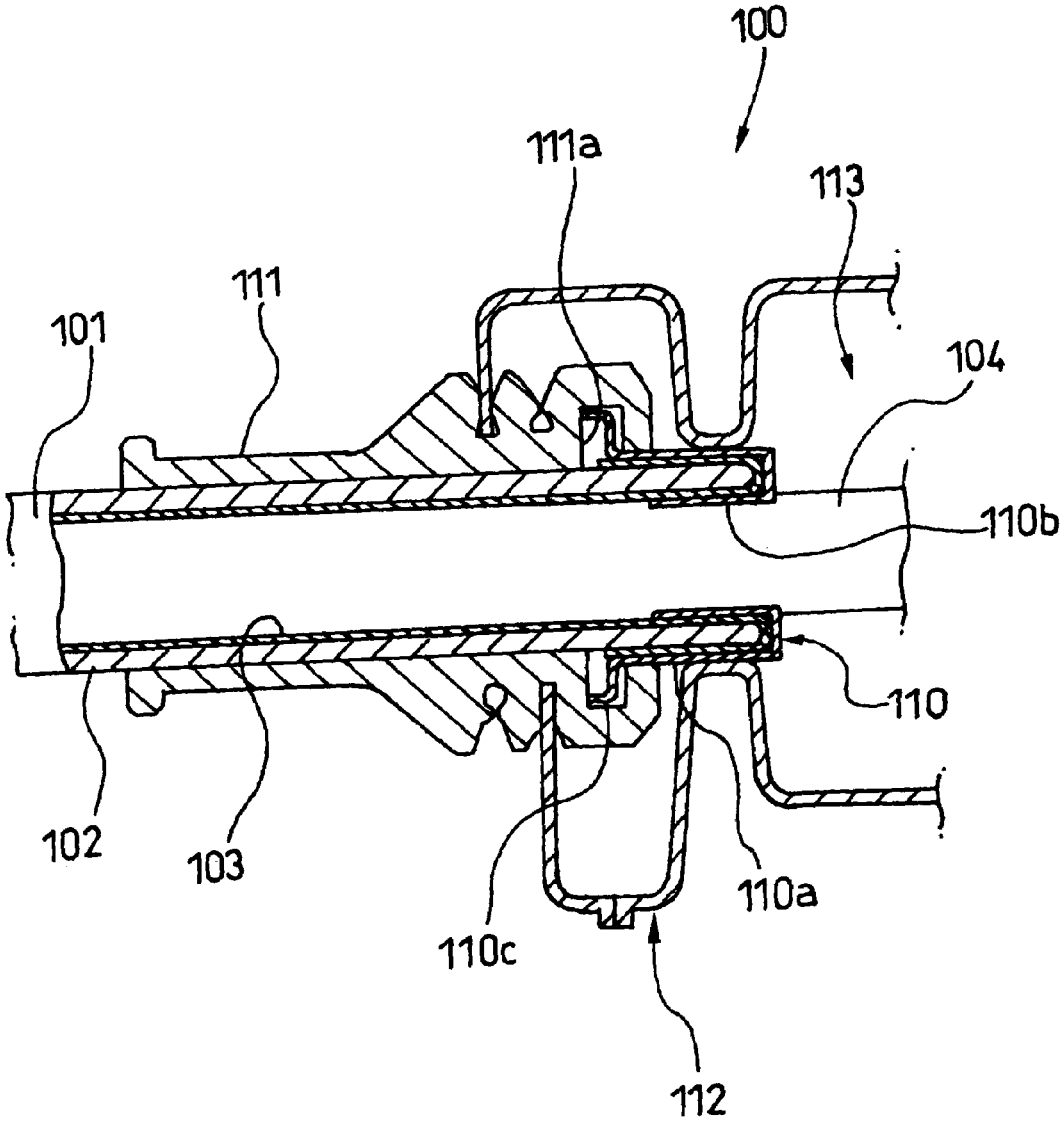
FIG. 10 PRIOR ART
FIG. 10 is a cross-sectional view showing a conventional electromagnetic interference shielded connector.

An embodiment according to the present invention will hereinafter be described in detail with reference to the accompanying drawings. FIG. 1 is a perspective view of an electromagnetic interference shielded connector according to an embodiment of the present invention as seen from above; FIG. 2 is a perspective view of the electromagnetic interference shielded connector as seen from below; FIG. 3 is a perspective view of a shielding shell as seen from above; FIG. 4 is a perspective view of the shielding shell as seen from below; FIG. 5 is a cross-sectional view showing the front end and a mounting portion of the electromagnetic interference shielded connector; FIG. 6 is an enlarged cross-sectional view showing the part VI in FIG. 5; FIG. 7 is an enlarged cross-sectional view showing the part VII in FIG. 5; FIG. 8 is a perspective view of a female connector; and FIG. 9 is a perspective view showing a state where the electromagnetic interference shielded connector is mounted on a motor.

As shown in FIG. 1 and FIG. 2, an electromagnetic interference shielded connector 10 according to the embodiment of the present invention has a plurality of electric wires 11; male terminals 21 serving as connecting parts at the front ends of the respective plurality of electric wires 11; a connector housing 20 for housing the plurality of electric wires 11 and the male terminals 21; and a metallic shielding shell 30 made of, for example, aluminum and to be assembled on the connector housing 20.

In addition, the case where the respective electric wires 11 include braids 11*b* in the outermost layer will hereinafter be described.

As shown in FIG. 3 and FIG. 4, the shielding shell 30 has a thin and approximately rectangular box shape, and is opened on the proximal end side (upper left side in FIG. 3 and FIG. 4) to have a cylindrical electric-wire drawn-out portion 31 adapted to draw out the plurality of electric wires 11 therethrough.

Also, on the front end side (lower right side in FIG. 3 and FIG. 4) is opened the bottom surface (this side in FIG. 4) to have a terminal drawn-out portion 32 adapted to protrude the male terminals 21 as the connecting parts (refer to FIG. 2). Furthermore, on both left and right sides 30*a* and 30*b* of the shielding shell 30 are provided mounting brackets 33 as mounting portions for mounting the shielding shell 30 on a wall part 41 of a device such as motor 40 (refer to FIG. 9).

As shown in FIG. 1, FIG. 2 and FIG. 5, the electric wires 11 with cores 11*a* which are exposed at the front ends thereof are inserted through the electric-wire drawn-out portion 31 of the shielding shell 30 so that the male terminals 21 are connected with the cores 11*a*, respectively.

The connector housing 20 is formed by an entire molding with a resin 23 such as SPS resin under such a condition that front end portions 21*a* of the male terminals 21 are protruded from the terminal drawn-out portion 32.

On the side of the terminal drawn-out portion 32 of the shielding shell 30, a front end portion 20*a* of the connector housing 20 is provided by an entire covering in such a manner as to protrude downward below the terminal drawn-out portion 32 to include the male terminals 21 internally. A packing 22 is provided on the outer circumferential surface of the front end portion 20*a*.

Therefore, when mounting the electromagnetic interference shielded connector 10 on the wall part 41 of the motor 40, the connection between the front end portion 20*a* of the connector housing 20 and the wall part 41 is sealed so as to provide waterproofing by the packing 22.

As shown in FIG. 5 and FIG. 7, cores 11*a* of the respective electric wires 11 are exposed at the front ends. Lower portions of the cores 11*a* are connected to thin plate-shaped rear end portions 21*b* of the male terminals 21.

The male terminals 21 are extended forward (rightward in FIG. 7) inside the shielding shell 30, and then bent downward at a right angle, as shown in FIG. 6, in such a manner that the front end portions 21*a* protrude downward below the terminal drawn-out portion 32 of the shielding shell 30.

As shown in FIG. 6, a female connector 42 is fitted inside the wall part 41 of the motor 40. A male connector insertion groove 41*a* for fitting the elliptic-shaped connector housing front end portion 20*a* of the electromagnetic interference shielded connector 10 is formed between the wall part 41 and a housing front end portion 42*a* of the female connector 42.

A packing 44 is fitted into a low side of the housing front end portion 42*a* of the female connector 42 so as to be brought into close contact with the wall part 41.

As shown in FIG. 8, the female connector 42 has front end portions 42*a* to be fitted inside the connector housing front end portion 20*a* of the electromagnetic interference shielded connector 10, in the upper surfaces of the respective front end portions 42*a* being provided terminal insertion holes 42*b* for inserting the respective male terminals 21 thereinto.

As shown in FIG. 6, female terminals 43 are provided in the respective terminal insertion holes 42*b*. The female terminals 43 are brought into contact, respectively, with the male terminals 21 for electrical connection. A lower end portions 43*a* of the female terminals 43 are exposed at inside of the motor 40 as shown in FIG. 8.

Therefore, when the front end portion 20*a* of the connector housing 20 is fitted into the male connector insertion groove 41*a* and the male terminals 21 is inserted into the respective terminal insertion holes 42*b*, the front end portions 21*a* of the male terminals 21 are brought into contact, respectively, with the female terminals 43 for electrical connection as shown in FIG. 6.

In the case above, the packing 22 provided in the front end portion 20*a* of the connector housing 20 is brought into close contact with the outer wall surface of the male connector insertion groove 41*a* to keep waterproof characteristics.

Meanwhile, on the side of the electric-wire drawn-out portion 31 of the shielding shell 30, the braids 11*b* provided in the outermost layer are peeled off outward at the front end portions of the respective electric wires 11 to insert the internal core into the shielding shell 30 through the electric-wire drawn-out portion 31 as shown in FIG. 7.

Then, in a state that the front ends of the cores 11*a* are connected, respectively, to the rear end portions 21*b* of the male terminals 21, the electric wires 11 and the shielding shell 30 are entirely molded with the resin 23. The braids 11*b* are then covered on the outer side surface of the shielding shell 30 from behind the shielding shell 30 and tightened thereto using a shell ring 34.

Therefore, the braids 11*b* can be reliably attached to the shielding shell 30.

To mount the thus prepared electromagnetic interference shielded connector 10 on the motor 40, the connector housing front end portion 20*a* is fitted into the male connector insertion groove 41*a* provided in the motor 40 to connect the male terminals 21 and the female terminals 43, respectively. Further, the mounting brackets 33 provided in the shielding shell 30 are fixed to a mounting portion 45 of the motor 40 with bolts 35, as shown in FIG. 9.

In accordance with the above-mentioned electromagnetic interference shielded connector 10, the interior of the shielding shell 30 is molded entirely with the resin 23 under such conditions that the electric wires 11 are inserted through the electric-wire drawn-out portion 31 and that the front end portions 21*a* of the male terminals 21 are protruded from the terminal drawn-out portion 32. It is thus not necessary to fit shielding shells in a sandwiching manner from above and below as used conventionally, which allows the number of parts to be reduced and wasted space to be eliminated for size reduction. It is also possible to ensure a waterproof function.

In addition, the braids 11*b* of the electric wires 11 are covered on the outer circumferential surface of the electric-wire drawn-out portion 31 and tightened thereto using the shell ring 34, whereby it is possible to attach the braids 11*b* to the shielding shell 30 reliably, which allows electromagnetic waves to be shielded more reliably.

In addition, the electromagnetic interference shielded connector of the present invention is not restricted to the above-mentioned embodiment, but there may be appropriate variations, modifications, etc.

That is, although the case where the electric wires 11 include the braids 11*b* respectively in the outermost layer has been described in the above-mentioned embodiment, the same can be applied similarly to the case where there are sheaths outside the respective braids 11*b*.

The present application is based on Japan Patent Application No. 2004-039810 filed on Feb. 17, 2004, the contents of which are incorporated herein for reference.

What is claimed is:

1. An electromagnetic interference shielded connector, comprising:

a plurality of electric wires, which has connecting parts at ends of the electric wires respectively;

a connector housing, which contains the electric wires and the connecting parts;

a metallic shielding shell, which includes:

an electric-wire drawn-out portion, through which the electric wires are drawn out; and a terminal drawn-out portion, from which the connecting parts are protruded; and a shell ring which is attached to an outer circumferential surface of the electric-wire drawn-out portion to secure a braid to the shielding shell.

2. The electromagnetic interference shielded connector as set forth in claim 1, wherein the terminal drawn-out portion is opened toward female terminals of a mating device;

wherein the connecting parts are connectable with the female terminals; and wherein a packing is provided between the terminal drawn-out portion and the mating device to seal the connecting parts.

3. The electromagnetic interference shielded connector as set forth in claim 1, wherein the shielding shell has a mounting portion for mounting the shielding shell on a wall part of a mating device.

4. A method for assembling an electromagnetic interference shielded connector, comprising the steps of:

providing a plurality of electric wires which has connecting parts at ends of the electric wires respectively;

providing a connector housing which contains the electric wires and the connecting parts; and providing a metallic shielding shell which includes a cylindrical electric-wire drawn-out portion and a terminal drawn-out portion; and forming the connector housing by injecting a resin inside of the metallic shielding shell in a state that the electric wires are inserted into the shielding shell through the electric-wire drawn-out portion and the connecting parts are exposed through the terminal drawn-out portion.

5. An electromagnetic interference shielded connector, comprising:

a plurality of electric wires, which has connecting parts at ends of the electric wires respectively;

a connector housing, which contains the electric wires and the connecting parts; and a metallic shielding shell, which includes:

an electric-wire drawn-out portion, through which the electric wires are drawn out; and a terminal drawn-out portion, from which the connecting parts are protruded, wherein the terminal drawn-out portion is opened toward female terminals of a mating device;

wherein the connecting parts are connectable with the female terminals; and wherein a packing is provided between the terminal drawn-out portion and the mating device to seal the connecting parts.

* * * * *